US009863591B2

(12) United States Patent
Germain et al.

(10) Patent No.: US 9,863,591 B2
(45) Date of Patent: Jan. 9, 2018

(54) LIGHTING FIXTURE WITH REPLACEABLE LIGHT ENGINE

(71) Applicant: GE LIGHTING SOLUTIONS, LLC, East Cleveland, OH (US)

(72) Inventors: Steve Germain, L'lle-Perrot (CA); David Kim Soui Wan Fong, Brossard (CA); Yaseen Ahmed Waheed, St-Laurent (CA); Matthew A. Bugenske, Shaker Heights, OH (US); Majid Khan, Saint-Laurent (CA); Justin Rioux, Boucherville (CA)

(73) Assignee: GE LIGHTING SOLUTIONS, LLC, East Cleveland, NY (US)

( * ) Notice: Subject to any disclaimer, the term of this patent is extended or adjusted under 35 U.S.C. 154(b) by 29 days.

(21) Appl. No.: 14/965,762

(22) Filed: Dec. 10, 2015

(65) Prior Publication Data

US 2017/0167665 A1 Jun. 15, 2017

(51) Int. Cl.
*F21K 99/00* (2016.01)
*F21S 8/06* (2006.01)
(Continued)

(52) U.S. Cl.
CPC . *F21S 8/06* (2013.01); *F21S 4/28* (2016.01); *F21V 17/002* (2013.01);
(Continued)

(58) Field of Classification Search
None
See application file for complete search history.

(56) References Cited

U.S. PATENT DOCUMENTS 5,651,606 A * 7/1997 Krogman ..... F21V 31/00 362/267
5,738,436 A * 4/1998 Cummings ..... F21S 8/026 362/148

(Continued)

FOREIGN PATENT DOCUMENTS

EP 2952806 A1 12/2015
KR 100949452 B1 3/2010

OTHER PUBLICATIONS

International Search Report and Written Opinion issued in connection with corresponding PCT Application No. PCT/US2016/061255 dated Mar. 22, 2017.

*Primary Examiner* — Ashok Patel
(74) *Attorney, Agent, or Firm* — Peter T. DiMauro; GE Global Patent Operation

(57) ABSTRACT

The specification and drawings present a new apparatus such as a lighting fixture and a method for replacing a light engine such as a LED light engine in the lighting fixture by replacing one part carrying the light engine, where the heat sink (e.g., extruded elongated heat sink) can be split into two parts, a replaceable part carrying the light engine and a fixed part. Both heat sink parts may be attached together with a clip to allow the unclipping and replacement of the removable part carrying the light engine. The geometry of the two heat sink parts can be designed in such a way that one part can be attached on top of the other, while providing a predefined alignment and continuous thermal conductivity between the two parts. A space between the two parts can be used to place the clip.

19 Claims, 12 Drawing Sheets

(51) Int. Cl.

| | |
|---|---|
| ***F21V 23/00*** | (2015.01) |
| ***F21V 17/00*** | (2006.01) |
| ***F21V 17/16*** | (2006.01) |
| ***F21V 29/70*** | (2015.01) |
| ***F21V 29/71*** | (2015.01) |
| ***F21S 4/28*** | (2016.01) |
| *F21Y 103/10* | (2016.01) |
| *F21Y 115/10* | (2016.01) |
| *F21V 7/00* | (2006.01) |
| *F21V 7/05* | (2006.01) |

(52) U.S. Cl.

CPC ..... *F21V 17/164* (2013.01); *F21V 23/002* (2013.01); *F21V 23/003* (2013.01); *F21V 29/70* (2015.01); *F21V 29/71* (2015.01); *F21V 7/005* (2013.01); *F21V 7/05* (2013.01); *F21Y 2103/10* (2016.08); *F21Y 2115/10* (2016.08)

(56) References Cited

U.S. PATENT DOCUMENTS

| | | | | |
|---|---|---|---|---|
| 2012/0145699 | A1* | 6/2012 | McMahan ..... | H05B 3/0076<br>219/533 |
| 2013/0093325 | A1 | 4/2013 | Scarpelli | |
| 2015/0092410 | A1 | 4/2015 | Boyer et al. | |

* cited by examiner

LIGHTING FIXTURE WITH REPLACEABLE LIGHT ENGINE

TECHNICAL FIELD

The invention generally relates to lighting systems. More particularly but not exclusively, this invention relates to lighting fixtures comprising LED light sources with replaceable light engines.

BACKGROUND OF THE INVENTION

In recent years, a movement has gained traction to replace incandescent light bulbs with lighting fixtures that employ more efficient lighting technologies as well as to replace relatively efficient fluorescent lighting fixtures with lighting technologies that produce a more pleasing, natural light. One such technology that shows tremendous promise employs light emitting diodes (LEDs). Compared with incandescent bulbs, LED-based light fixtures are much more efficient at converting electrical energy into light, are longer lasting, and are also capable of producing light that has a very natural-seeming spectral distribution of light frequencies or colors.

Compared with fluorescent lighting, LED-based fixtures are more efficient, and are capable of producing light that is much more natural and more capable of accurately rendering colors. Moreover, fluorescent light bulbs/fixtures have a theoretical long life span (some reports indicate approximately 10,000 hours), but failures occur much more frequently due to bulb and power supply issues. For example, the fluorescent bulbs require special ballast and starter devices that provide sufficient energy to create plasma within the bulb to cause it to glow. The high surges of current cause frequent failures of the ballast or starter devices. Replacement of these components usually requires disassembly of the cabinet or display case in which they are housed, which is particularly inconvenient and potentially hazardous when the fixture is ceiling-mounted, and the service person must climb a ladder to perform the service operation.

Although fluorescent bulbs can last approximately 10,000 hours, this is significantly shorter than the service life offered by current LED technology. Illumination sources that feature LEDs can withstand over 60,000 hours of continuous use. Moreover, LED sources are not as prone to failure due to on/off switching. The fluorescent light bulb requires an initial high current surge to start illumination. This surge is not needed in LED light sources.

As a result, lighting fixtures that employ LED technologies are expected to replace incandescent and fluorescent bulbs in residential, commercial, and industrial applications.

BRIEF DESCRIPTION OF THE DRAWINGS

These and other features and aspects of the present disclosure will become better understood when the following detailed description is read, with reference to the accompanying drawings, in which like characters represent like parts throughout the drawings, wherein.

DETAILED DESCRIPTION

Figure 1A:
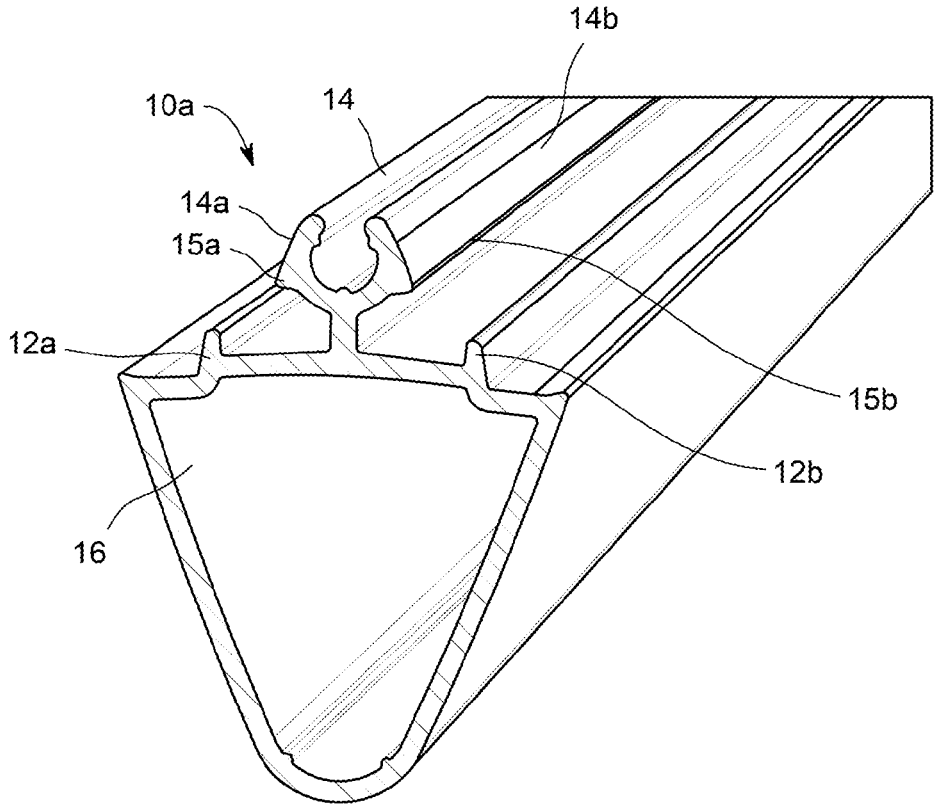
FIGS. 1A and 1B are exemplary views of a fixed heat sink part as a fixed extruded elongated part (FIG. 1A) and a replaceable heat sink part as a replaceable elongated part (FIG. 1B) according to an embodiment of the invention.

Current implementations of LED light fixtures have fixed, integrated and non-replaceable light engines. There is a desire from customers/users to enable easy replacement of the light engine without involving an electrician and/or while avoiding the need for disassembling the entire fixture to replace the light engine. It is also desirable to be able to upgrade the light engines of the fixtures with the newest technology without having to replace the entire fixtures. Various embodiments of this invention facilitate easy replacement of a light engine on a light fixture like a linear LED light fixture.

A new apparatus such as a lighting fixture and a method are presented for replacing a light engine such as a LED light engine in the lighting fixture by replacing/swapping out one part carrying the light engine, where the heat sink (e.g., extruded elongated heat sink) can be split into two parts (modules), a replaceable part carrying the light engine and a fixed part. According to various embodiments described herein, both heat sink parts may be attached together with a clip that is strong enough to hold the light engine in the light fixture, yet flexible enough to allow unclipping and replacement of the removable part carrying the light engine. The geometry of the two heat sink parts (e.g., elongated extruded removable and fixed parts) can be designed in such a way that one part can be attached on top of the other, while providing a predefined alignment and continuous thermal conductivity between the two parts. A space between the two parts can be used to place the clip. The clip could be made of a plastic material, a metal material (e.g., using sheet metal) based on the desired properties, such as tensile strength, flexibility, elasticity, thermal conductivity, electrical conductivity, and the like.

It is noted that in the context of the present invention a term "replaceable part" means that this replaceable part carrying the light engine can be removed, replaced (e.g., in case of a problem with the light engine) or upgraded by a customer by following simple instructions, without the help of an electrician and/or without the need of disassembling the entire fixture to replace the light engine.

According to one embodiment of the invention, a lighting fixture can comprise a heat sink which contains two parts (e.g., each part being extruded and elongated): a fixed part/module, and a replaceable part/module, supporting or carrying a light engine, which is in a thermal contact with the replaceable part, where the fixed part is attachable to, and detachable from, the replaceable part using corresponding clipping and unclipping procedures/mechanisms, the replaceable and fixed parts being in juxtaposed aligned relationship when attached. In the attached state, at least one area of the fixed part may be in direct contact with at least one further area of the replaceable part, in order to provide continuous thermal conductivity between the fixed and replaceable parts. A clip, located in a space between the fixed and replaceable parts in the attached state, can be used for facilitating/providing the clipping and unclipping procedures/mechanisms, and further for providing a certain amount of thermal conductivity between the fixed and replaceable parts being in further direct contact with corresponding areas of the fixed and replaceable parts. The at least one and at least one further areas can be elongated along a length of the fixed part and the replaceable part, as demonstrated at least in FIGS. 1A, 1B and 2 discussed below.

Moreover, in some applications or future application, it may be possible that the replaceable part of the heat sink can provide enough heat transfer by itself (low lumen output applications; better LEDs with improved efficiency, etc.). For such cases, the thermal conductivity of the fixed heat sink part and the thermal contact between the replaceable and fix heat sink parts may be less important, making non-mandatory the direct physical contact between corresponding areas of the fixed and replaceable parts for specific designs.

According to further embodiments, the light engine may comprise one or more light emitting diodes (LEDs). Moreover, the fixed part may be a hollow extrusion which can be configured to permit passage of electrical wiring for powering adjacent fixtures. Further, the clip may be a free-standing part and/or permanently attached to (or combined with) one of the fixed and replaceable parts as demonstrated in FIGS. 5*a* and 5*b* and further discussed herein. Also, the clip may be easily replaced if damaged.

Furthermore, the lighting fixture can be a suspended lighting fixture with the replaceable part being above or below the fixed part. In the latter case, the lighting fixture may further comprise a safety lock for the replaceable part in the attached state. Still further, the fixed and replaceable heat sink parts (extrusions) preferably comprise aluminum, aluminum alloys or other metal or non-metal materials having good thermal conductivity (e.g., high thermal conductivity plastic materials).

Examples of materials which can be used for a fixed part/extrusion may include (but are not limited to): aluminum alloy 6063-T6 or 6360-T6, glass or carbon fiber reinforced plastic-like polycarbonate, and the like. Examples of materials which can be used for a replaceable part/extrusion may include (but are not limited to): aluminum alloy 6063-T6 or 6360-T6, thermally conductive plastic (with filler such as graphite fibers, metalized glass fibers, aluminum fibers and flakes), regular plastics like polycarbonate for low power applications, and the like.

According to other embodiments, the lighting fixture may be configured to accommodate various types of light engines/LED light engines emitting different lumen output values and/or having different color temperatures, etc. Then a driver module of the light fixture can be configured to provide a different electrical driving power to each replaceable part of a plurality of replaceable parts carrying different light engines configured to emit different predefined lumen output values. In this case, the electrical driving power can be provided by the driver module to each of the different (replaceable) light engines using a dedicated electrical connector, e.g., using a unique (different) type of connector for connecting to different replaceable heat sink parts carrying different light engines (as demonstrated in FIG. 9A), as further described below. Alternatively, the electrical driving power may be provided by the driver module to each of the different light engines (carried by corresponding replaceable parts) using different dedicated pins of one multi-pin electrical connector (as demonstrated in FIG. 9B), as further described below.

FIGS. 1A-1B, 2, 3A-3B, 4A-4B, 5A-5B, 6, 7A-7E, 8 and 9A-9B demonstrate non-limiting examples for practicing various embodiments of the invention described herein. For clarity, identical/similar components in these figures are assigned the same reference numbers.

Figure 1B:
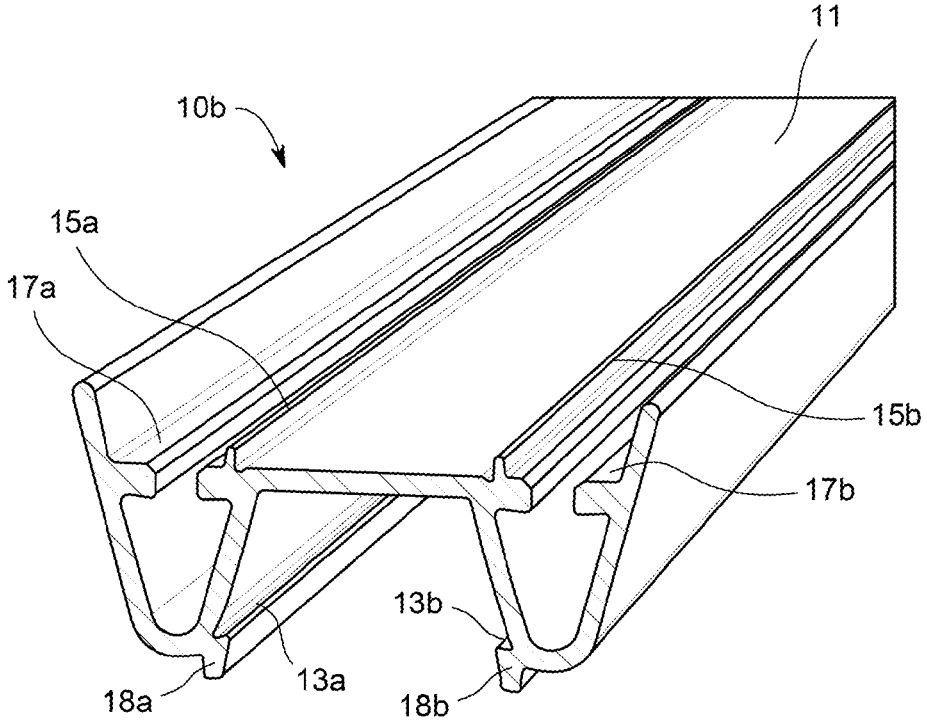
Figure 3A:
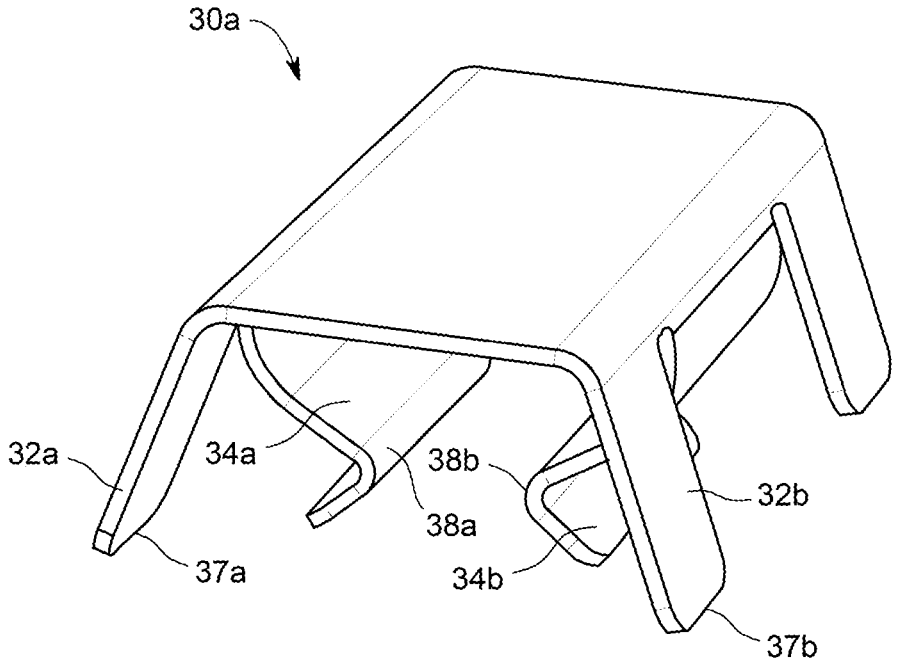
FIGS. 3A and 3B are exemplary views of a metal clip (FIG. 3A) and a plastic clip (FIG. 3B) designed for providing clipping and unclipping of the fixed and replaceable parts, according to further embodiments of the invention.
Figure 3B:
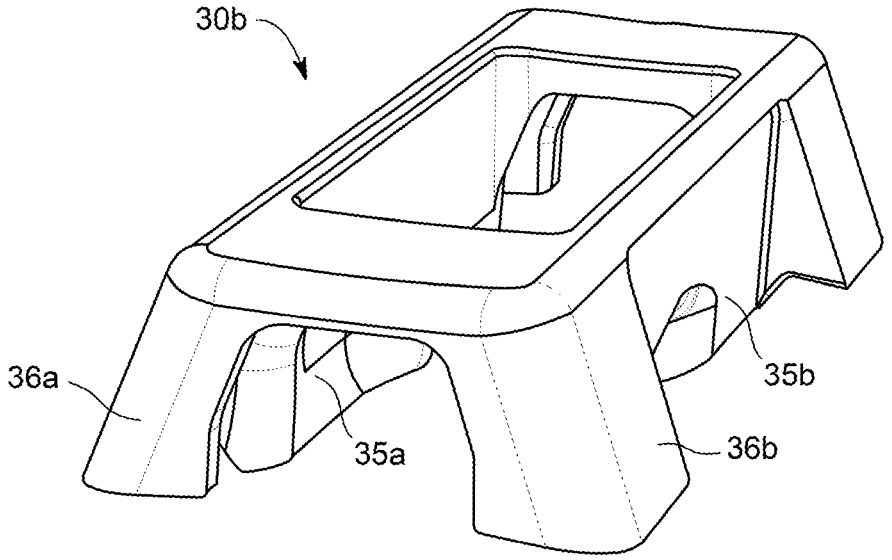
Figure 4A:
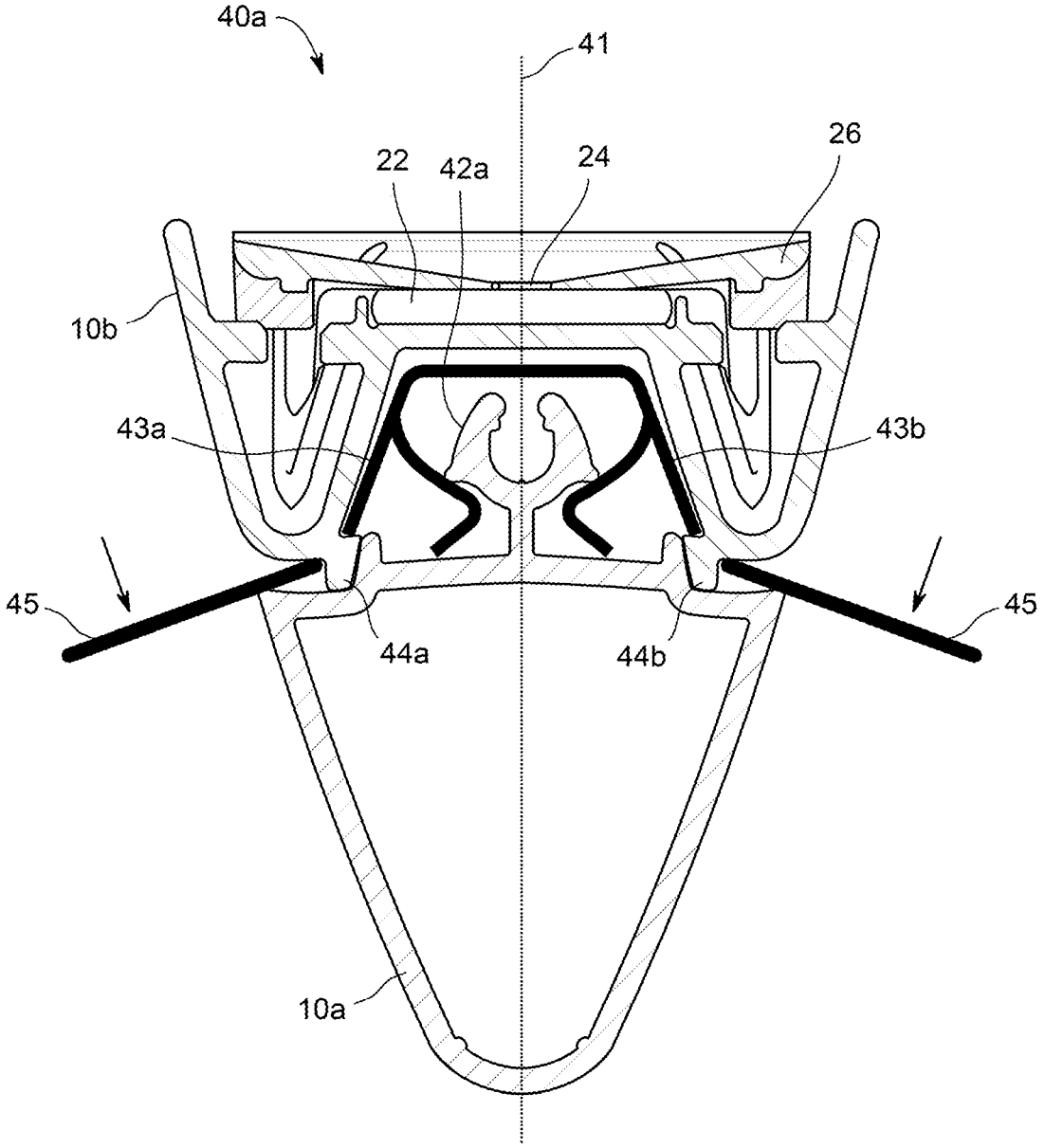
FIGS. 4A and 4B are exemplary views of assemblies comprising the replaceable part (shown in FIG. 1A) being attached on a top of the fixed part (shown in FIG. 1B) using the metal clip (FIG. 4A) and the plastic clip 30*b* (FIG. 4B) respectively, according to further embodiments of the invention.
Figure 4B:
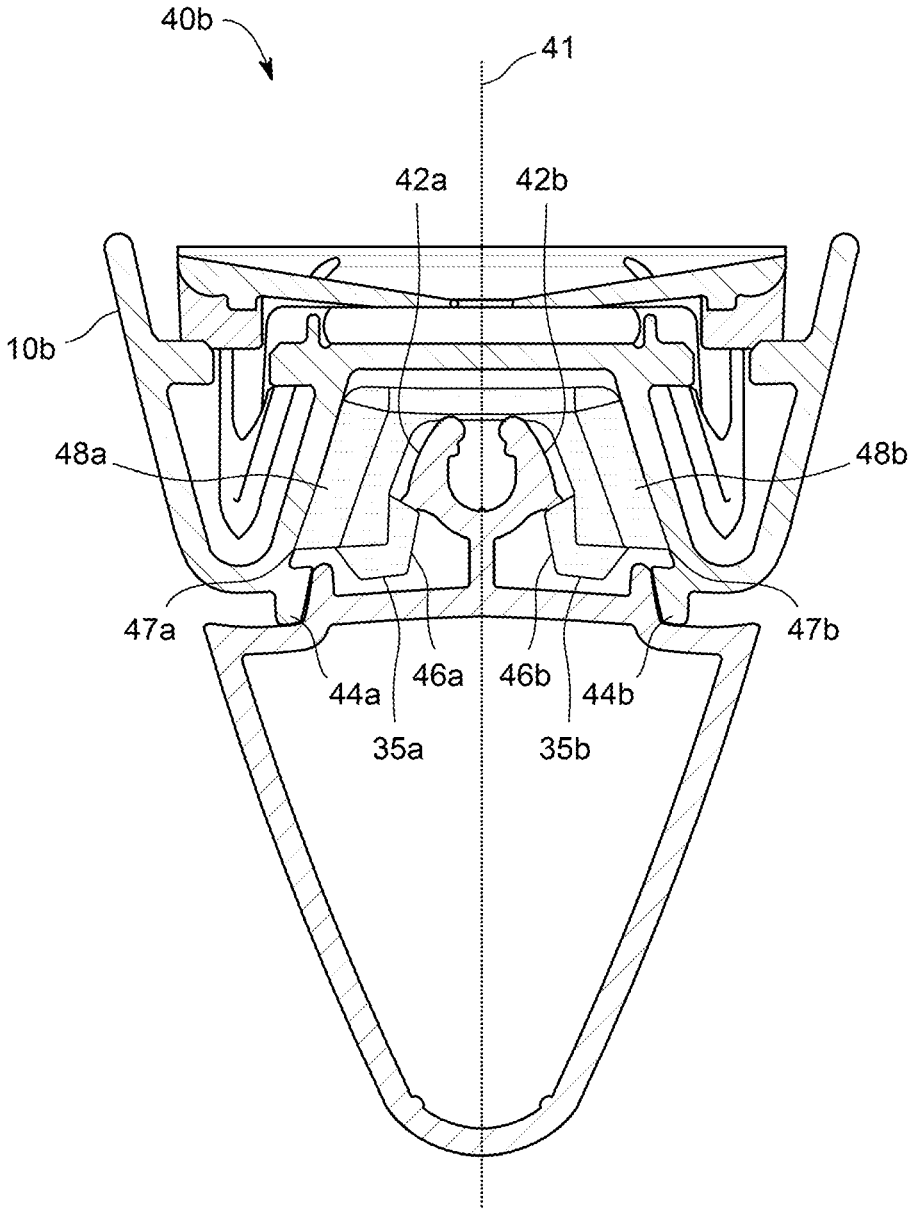

FIGS. 1A and 1B are exemplary views of a fixed heat sink part as a fixed extruded elongated part 10*a* (FIG. 1A) and a replaceable heat sink part as a replaceable extruded elongated part 10*b* (FIG. 1B) according to one embodiment of the invention. Both parts 10*a* and 10*b* can be made of aluminum/aluminum alloys or other materials having a high thermal conductivity, as described above. The fixed part 10*a* in FIG. 1A comprises two rail-like features 12*a* and 12*b* to provide thermal contact with similar features 18*a* and 18*b* of the replaceable part 10*b* when parts 10*a* and 10*b* are attached and aligned as shown in FIG. 3. A protrusion feature 14 has two side rail-like features 14*a* and 14*b* with corresponding tip lines 15*a* and 15*b* to provide snapping engagement of the fixed part 10*a* with a clip 30*a* or 30*b* (see examples in FIGS. 3A and 3B) as shown in FIGS. 4A and 4B and discussed below. Moreover, the fixed part 10*a* can be made as a hollow extrusion having an opening 16 which can be used to accommodate or carry through electrical wiring for powering adjacent fixtures. The replaceable part 10*b* in FIG. 1B also comprises surfaces 11 and 17*a* and 17*b* for mounting and securing a light engine as shown in FIGS. 2, 4A and 4B.

Figure 2:
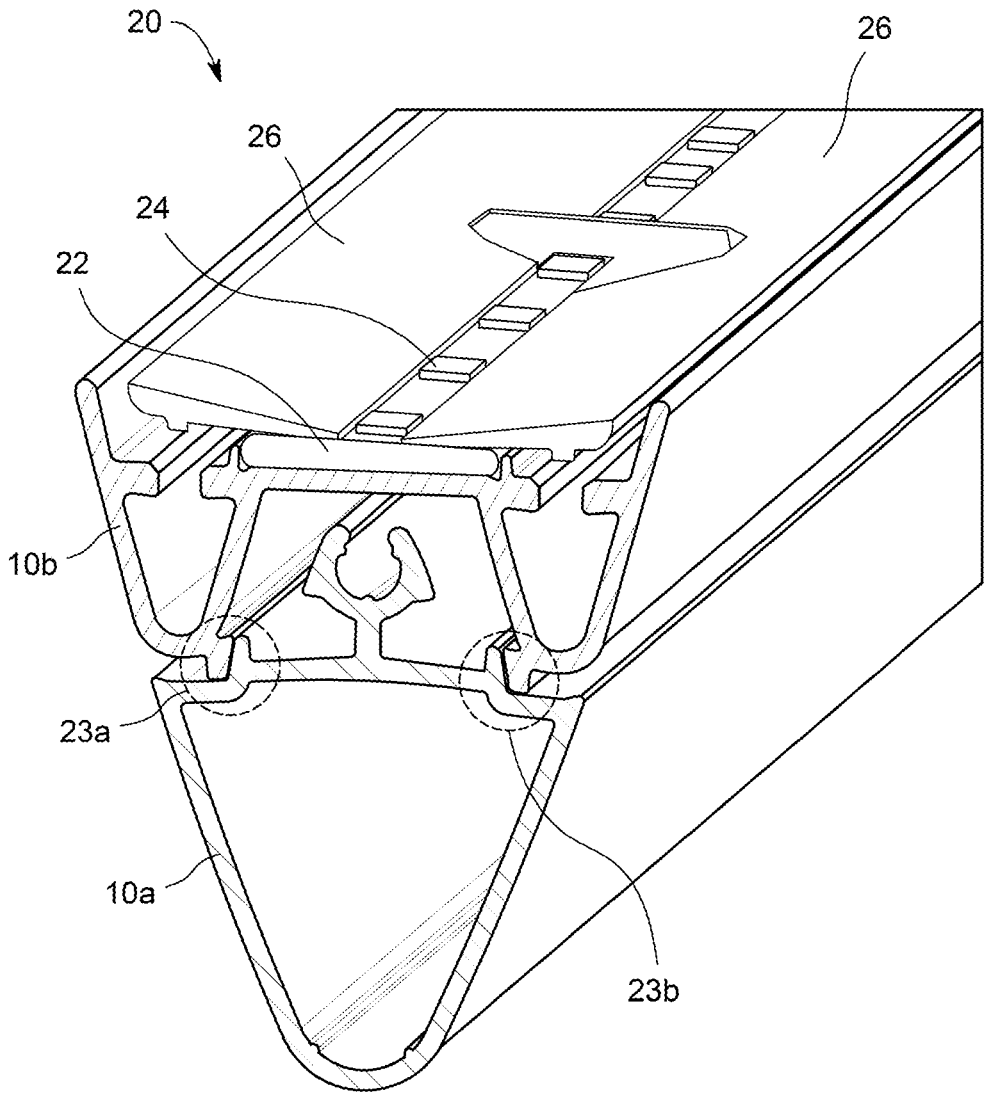
FIG. 2 is an exemplary view of the replaceable part and the fixed part, shown in FIGS. 1A and 1B respectively, in a juxtaposed aligned position, according to one embodiment of the invention.

FIG. 2 is an exemplary view of the replaceable part 10*b* on top of the fixed part 10*a* (shown in FIGS. 1A and 1B respectively) in a juxtaposed aligned position, according to an embodiment of the invention. It is seen that areas 23*a* and 23*b* comprising the rail-like features 12*a* and 18*a* as well as 12*b* and 18*b* of the parts 10*a* and 10*b* respectively (as shown in FIGS. 1A and 1B) are in physical contact which should provide continuous thermal conductivity between the parts 10*a* and 10*b*. Moreover, FIG. 2 shows components of an LED light engine securely placed on corresponding surfaces 11, 17*a* and 17*b* of the replaceable part 10*b*. Components of the LED light engine include a substrate 22, an array of surface-emitting LEDs 22*a* mounted on the substrate 22, and a reflector plate 26 of a reflection cavity (not shown in FIG. 2). The light engine is in thermal contact with the replaceable part 10*b*, so that the heat generated by the light engine is transferred to the replaceable part 10*b* and further to the fixed part 10*a* at least through the contact areas 23*a* and 23*b*.

FIGS. 3A and 3B are exemplary views of a metal clip 30*a* (FIG. 3A) and a plastic clip 30*b* (FIG. 3B) for providing clipping and unclipping of the fixed and replaceable parts

10*a* and 10*b*. As shown in FIG. 3A, the metal clip 30*a* is made of a rectangular sheet metal (e.g., high carbon spring steel, cold rolled steel like AISI C1075; stainless steel and the like), and comprises two pairs of corner legs 32*a* and 32*b* with corresponding tip lines 37*a* and 37*b*, and bent center legs 34*a* and 34*b* with corresponding bending lines 38*a* and 38*b*. The clip 30*b* is made of a plastic material (e.g., TEIJIN LN-1010RM, SABIC LEXAN LS1 or SABIC LEXAN 144R polycarbonates, engineering thermoplastic materials like PET, PBT or blend like PC/PET, PC/ABS and the like), and comprises two pairs of corner legs 36*a* and 36*b* and bent center legs 35*a* and 35*b*. It is further noted that it is desirable to choose a material of the clip having good thermal conductivity, in order to provide additional thermal conductivity between the replaceable and fixed parts 10*b* and 10*a*.

FIGS. 4A and 4B are exemplary views of assemblies 40*a* and 40*b* comprising the replaceable part 10*b* being attached on top of the fixed part 10*a* using the metal clip 30*a* (FIG. 4A) and the plastic clip 30*b* (FIG. 4B) respectively, according to further embodiments of the invention.

In assembly shown in FIG. 4A, first, the replaceable part 10*b* can be aligned and placed together with the clip 30*a*. Then, when the replaceable part 10*b* and the clip 30*a* are pushed toward each other, inside surfaces 44*a* and 44*b* of the rail-like features 18*a* and 18*b* of the replaceable part 10*b* (FIG. 1B) slide along the outer surfaces 43*a* and 43*b* of the legs 32*a* and 32*b* in the clip 30*a* (FIG. 3A) causing inward/side movement (toward the symmetry center line 41) of the legs 32*a* and 32*b* due to the elastic properties of the clip 30*a*. While the replaceable part 10*b* continues to move down and the surfaces 13*a* and 13*b* (FIG. 1*b*) pass corresponding tip lines 37*a* and 37*b* of the legs 32*a* and 32*b* (FIG. 3A), the legs 32*a* and 32*b* move outward (away from the symmetry center line 41) thus snapping the replaceable part 10*b* into engagement as shown in FIG. 4A. This can be designated as a "second clipping".

After the clip 30*a* is attached (clipped) to the flexible part 10*b*, next, the replaceable part 10*b* with the attached clip 30*a* may be attached to the fixed part 10*a*. The replaceable part 10*b* with the clip 30*a* can be placed on top of the fixed part 10*a* with the bent legs 34*a* and 34*b* (FIG. 3A) being aligned with the protrusion feature 14 (FIG. 1A). Then, when the replaceable part 10*b* assembled with the clip 30*a* is pushed down toward the fixed part 10*a*, the areas around bending lines 38*a* and 38*b* (of the bent legs 34*a* and 34*b* in FIG. 3A) slide along the surfaces 42*a* and 42*b* of the protrusion feature 14 (FIG. 1A) causing outward/side movement (away from a symmetry center line 41) of the legs 38*a* and 38*b* due to the elastic properties of the clip 30*a*. While the clip 30*a* continues to move down and when the lines 38*a* and 38*b* pass corresponding tip lines 15*a* and 15*b* of the protrusions feature 14 (FIG. 1A), the process is reversed (i.e., snapping occurs) causing opposite inward/side movement (toward the symmetry center line 41) of the legs 38*a* and 38*b* due to the elastic properties of the clip 30*a* until a desired position of the clip 30*a* is reached as shown in FIG. 4A. This can be designated as a "first clipping". The resulting assembly can provide thermal contact between the fixed heat sink part 10*a* and the replaceable heat sink part 10*b* where the rail-like features 12*a* and 12*b* of the fixed part 10*a* are in physical and thermal contact with the rail-like features 18*a* and 18*b* of the fixed part 10*b*.

It is further noted that assembling the structure shown in FIG. 4A can be performed in different ways. In one embodiment discussed above, attaching the replaceable part 10*b* to the clip 30*a* can be performed first ("first clipping"), and then attaching the assembled replaceable part 10*b* with the clip 30*a* to the fixed part 10*a* can be further performed ("first clipping") as described above. In another embodiment, attaching the clip 30*a* to the fixed part 10*a* can be performed first, followed by attaching the replaceable part 10*b* to the assembled fixed part 10*a* with the clip 30*a*. In other words, the implementation order of the "first clipping" and the 'second clipping" can be reversed.

According to a further embodiment, the replaceable part 10*b* can be removed from the assembly 40*a* using a straightforward procedure performed by the customer. A simple prying tool 45 (or a screwdriver) can be used to pry the replaceable part 10*b* in an areas between the replaceable and fixed parts 10*b* and 10*a* as shown in FIG. 4A. In one embodiment, the replaceable part 10*b* can be attached to the clip 30*a* one way, i.e., the clip 30*a* can permanently stay attached (after "second clipping") to the replaceable part 10*b*, so that the "first clipping" can be unclipped by moving bended legs 34*a* and 34*b* outward (away from the symmetry center line 41), when the replaceable part 10*b* is pried as shown in FIG. 4A. The geometry of the surface (fixed part ramp) 42*a* makes the "first clipping" easy while the "first unclipping" requires more force applied by using the prying tool 45 (corresponding to shallower clipping ramp angle and steeper unclipping ramp angle).

Figure 5A:
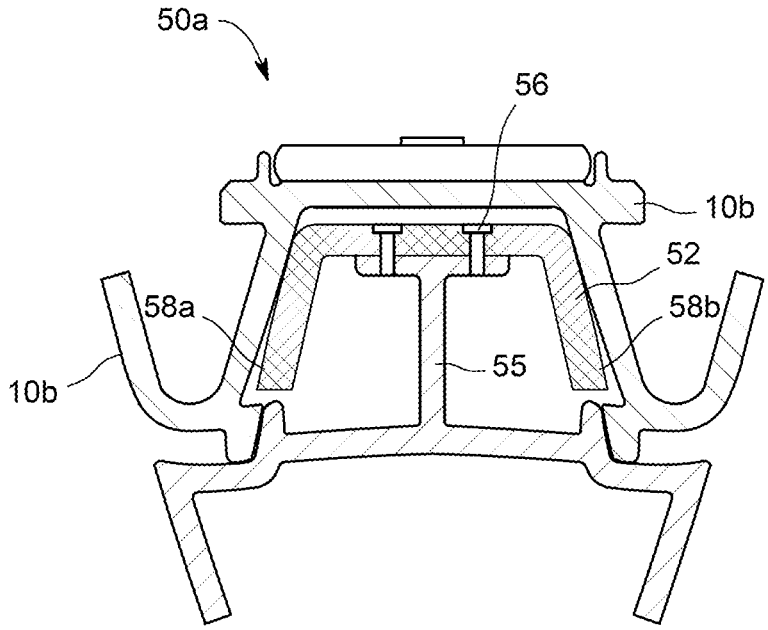
FIGS. 5A and 5B are exemplary cross-sectional views of assemblies with the replaceable part being attached on a top of the fixed part using one clip 52 (FIG. 5A) and another clip (FIG. 5B) respectively, according to further embodiments of the invention.

In another embodiment, the "second clipping" can be unclipped" (before the "first unclipping" occurs) when the replaceable part 10*b* is pried as shown in FIG. 4A, if the replaceable part 10*a* is designed to be flexible enough, so that the corresponding portion of the replaceable part 10*b* would move outward (away from the symmetry center line 41) an then up, thus releasing the "second clipping", i.e., facilitating a "second unclipping". It is further noted that the "second clipping" can be modified to be "softer" clipping as shown in FIG. 5A by modifying the clip 30A, as further discussed below, to reduce the force necessary for the "second unclipping".

It is noted that the force required for the "first unclipping" may be larger or smaller than the prying force required for the "second unclipping", which can be provided by choosing appropriate dimensions and properties of the parts 30*a*, 30*b*, 10 and 10*b*. Moreover, if necessary, the clip 30*a* may be removed/replaced as well after performing both, first and second, unclipping.

The assembly 40*b* shown in FIG. 4B is similar to the assembly 40*a* shown in FIG. 4A, so that the attachment procedure of the replaceable and fixed parts 10*b* and 10*a* is also similar. The difference is that, instead of the metal clip 30*a*, a plastic clip 30*b* is used. Then to accommodate the "second clipping", when the replaceable part 10*b* and the clip 30*b* are pushed toward each other, inside surfaces 44*a* and 44*b* of the rail-like features 18*a* and 18*b* of the replaceable part 10*b* (FIG. 1B) slide along the outer surfaces 48*a* and 48*b* of the legs 36*a* and 36*b* of the clip 30*b* (shown in FIG. 3B) causing inward/side movement (toward the symmetry center line 41) of the legs 36*a* and 36*b* due to the elastic properties of the clip 30*b*. While the replaceable part 10*b* continues to move down and the surfaces 13*a* and 13*b* (FIG. 1*b*) pass corresponding tip lines 47*a* and 47*b* of the legs 36*a* and 36*b* (FIG. 3B), the legs 36*a* and 36*b* move outward (away from the symmetry center line 41) and snap the replaceable part 10*b* as shown in FIG. 4B, thus attaching the replaceable part 10*b* with the clip 30*b*.

Moreover, to accommodate the "first clipping", when the clip 30*b* assembled with the clip 30*b* is pushed down toward the fixed part 10*a*, the surfaces 46*a* and 46*b* of the bent legs 35*a* and 35*b* slide along the surfaces (clipping ramp) 42*a* and 42*b* of the protrusion feature 14 (FIG. 1A) thereby causing outward/side movement (away from a symmetry center line 41) of the bent legs 35*a* and 35*b* due to the elastic properties of the clip 30*b*. While the clip 30*b* continues to move down and the surfaces 46*a* and 46*b* pass corresponding tip lines 15*a* and 15*b* of the protrusion feature 14 (FIG. 1A), the process is reversed (i.e., snapping occurs) causing inward/side movement (toward the symmetry center line 41) of the bent legs 35*a* and 35*b* due to the elastic properties of the clip 30*b* until a desired position of the clip 30*b* is reached as shown in FIG. 4B, thus providing the "first clipping" and thermal contact between the fixed heat sink part 10*a* and the replaceable heat sink part 10*b*. The "unclipping" procedures to remove the replaceable part 10*b* and possibly the clip 30*b* (if necessary to replace it) are similar to unclipping procedures as discussed herein in reference to FIG. 4A.

Figure 5B:
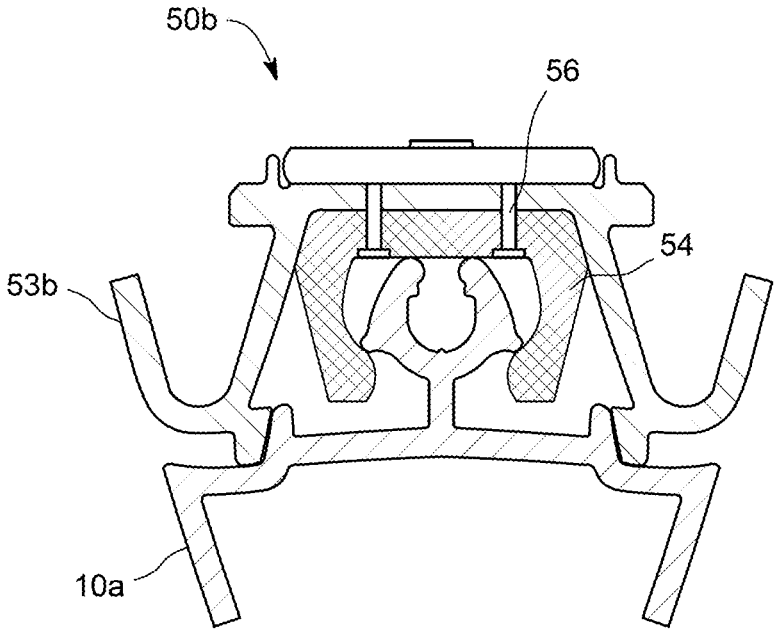

FIGS. 5A and 5B are exemplary cross-sectional views of assemblies 50*a* and 50*b* with the replaceable part 10*b* or 53*b* being attached on a top of the fixed part 53*a* or 10*a* using a clip 52 (FIG. 5A) and a clip 54 (FIG. 5B) respectively, according to further embodiments of the invention. The difference from the approach demonstrated in FIGS. 4A and 4B utilizing a free standing clips 30*a* and 30*b*, is that, in the examples shown in FIGS. 5A and 5B, the clips 52 and 54 are fastened to the fixed part 53*a* (FIG. 5A) or to the replaceable part 53*b* (FIG. 5B). Clips 52 and 54 may be similar to the clip 30*b* (FIG. 3B) but are simplified/modified (requiring only one type of legs) as described below.

In FIG. 5A, the clip 52 is attached to a T-shaped feature 55 of the fixed part 53*a* using fasteners 56. Then the "first clipping" described in reference to FIGS. 4A and 4B is not necessary, so that the replaceable part 10*b* can be attached directly on top of the fixed part 53*a* with the clip 52 in one step, thus providing the "second clipping" as described herein with reference to FIGS. 4A and 4B. The clip 52 is modified compared to the clips 30*a* and 30*b*, so it has only straight legs modified by thinning (chamfering) the legs at the ends 58*a* and 58*b*, respectively, to provide "softer" unclipping by reducing the required prying force. Removing the replaceable part 10*b* can be performed the same way as shown in FIG. 4A using a prying tool (screwdriver).

In FIG. 5B, the clip 54 is attached to a replaceable part 53*b* using fasteners 56. The replaceable part 53*b* is similar to the part 10*b* but for a provision for fastening with the clip 54 as shown in FIG. 5B. Then the "second clipping" described in reference to FIGS. 4A and 4B is not necessary, so that the replaceable part 53*b* (assembled with the clip 54) can be attached directly on top of the fixed part 10*a* in one step thus providing the "first clipping" as described herein with reference to FIGS. 4A and 4B. Removing the replaceable part 10*b* can be performed the same way as disclosed with reference to FIG. 4A using a prying tool.

Figure 6:
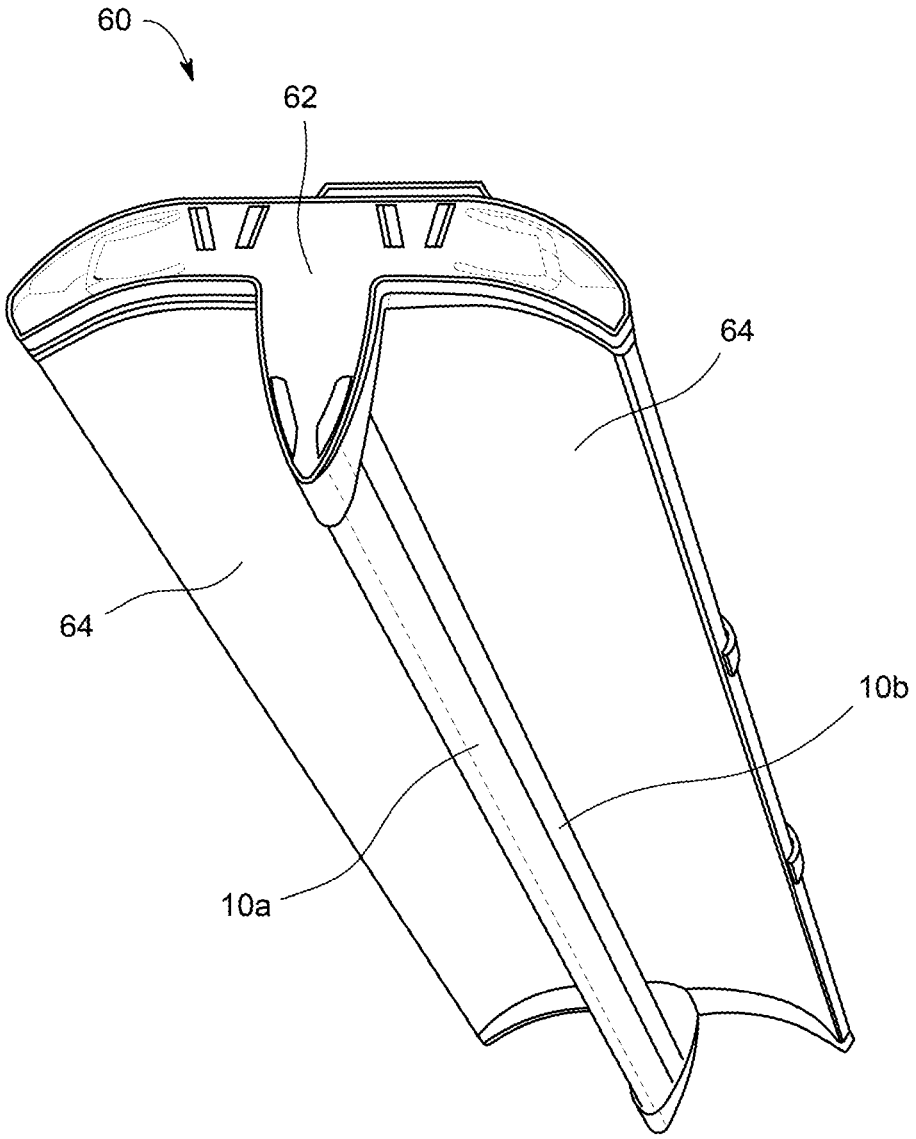
FIG. 6 is a perspective view of a suspended light fixture, which is designed to be mounted in a ceiling, according to one embodiment of the invention.

FIG. 6 is a view of a suspended light fixture 60, which is designed to be mounted in a ceiling, according to an embodiment of the invention. The light fixture 60 comprises a housing (frame) 62 configured to hold the replaceable part 10*b*, comprising the light engine, on the top of the fixed part 10*a*, as described herein. Also the housing 62 is configured to hold reflectors 64 for uniform distribution of the light generated by the light engine, and is further configured to be attached to the next similar light fixture.

Figure 7A:
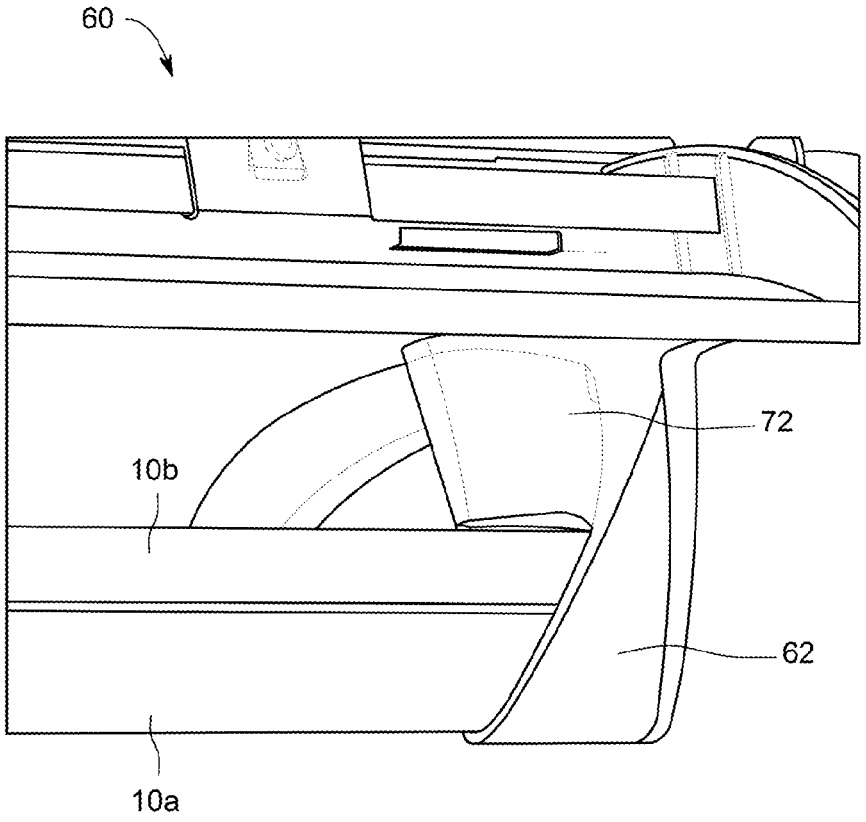
FIGS. 7A-7E are consecutive views demonstrating how to remove or swap out the replaceable part, comprising a light engine, from the light fixture shown in FIG. 6, according to one embodiment of the invention.
Figure 7B:
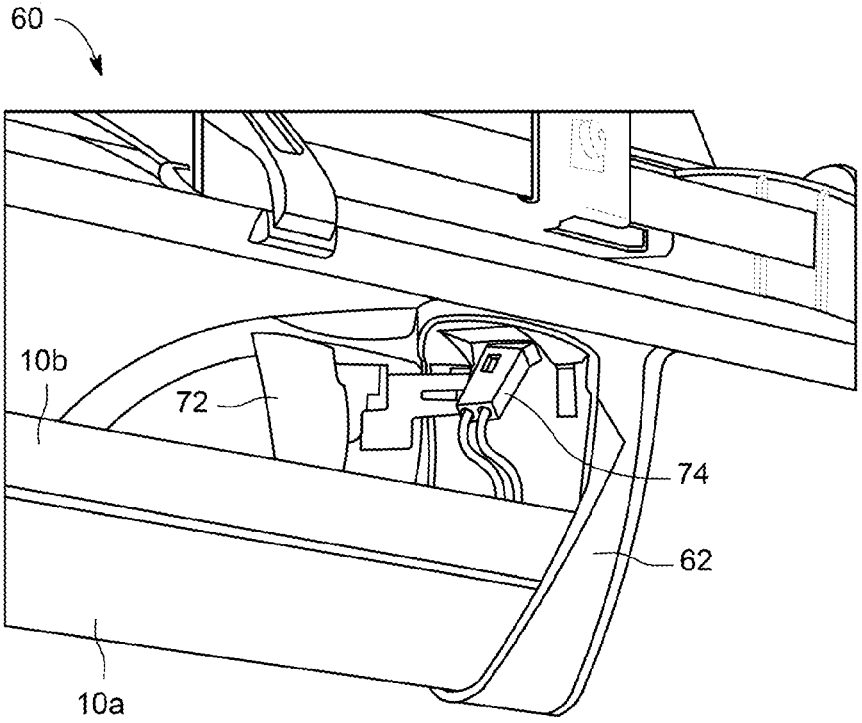

FIGS. 7A-7E are consecutive views demonstrating removal of the replaceable part 10*b*, comprising the light engine, from the light fixture 60 shown in FIG. 6. FIG. 7A shows a portion of the light fixture 60 clearly identifying the fixed part 10*a*, the replaceable part 10*b* and a cover 72 for electrical connector of the light engine. FIG. 7B shows the same portion of the light fixture 60 with the cover 72 being open. A two-pin electrical connector 74 provides an electrical connection of the light engine to a driver module, identified by the reference number 76 in FIGS. 7C and 7D (not visible in FIG. 7B). According to further embodiments of the invention, the driver module 76 can provide different driving currents (electrical powers) to different respective light engines comprising, for example, light sources like LEDs providing different lumen output values using multiple connectors or one multi-pin connector as discussed in reference to FIGS. 9A-9B below. In the case of using multiple connectors, a clear marking can be used on the connectors to guide the customer to make a connection to the right connector when replacing the light engine having a different power rating.

Figure 7C:
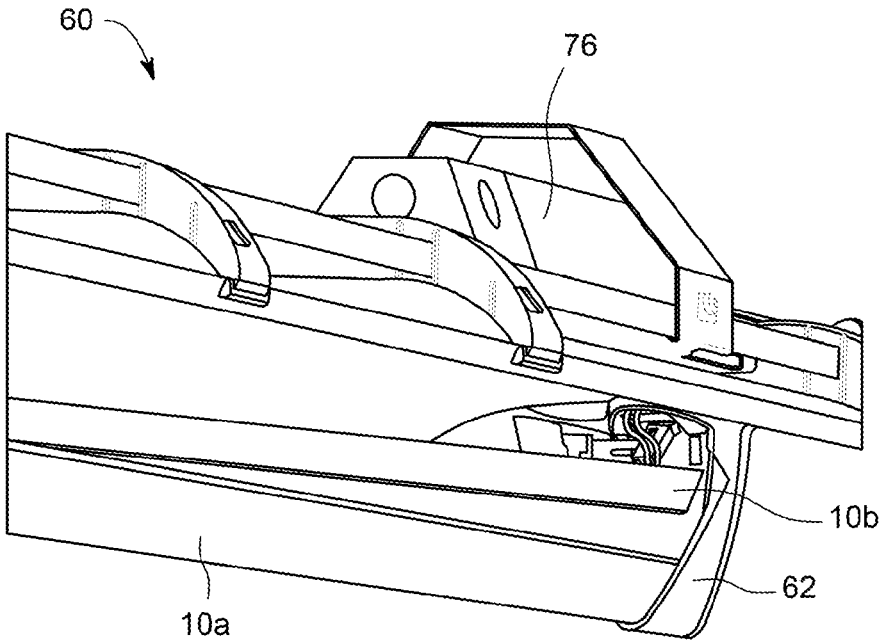
Figure 7D:
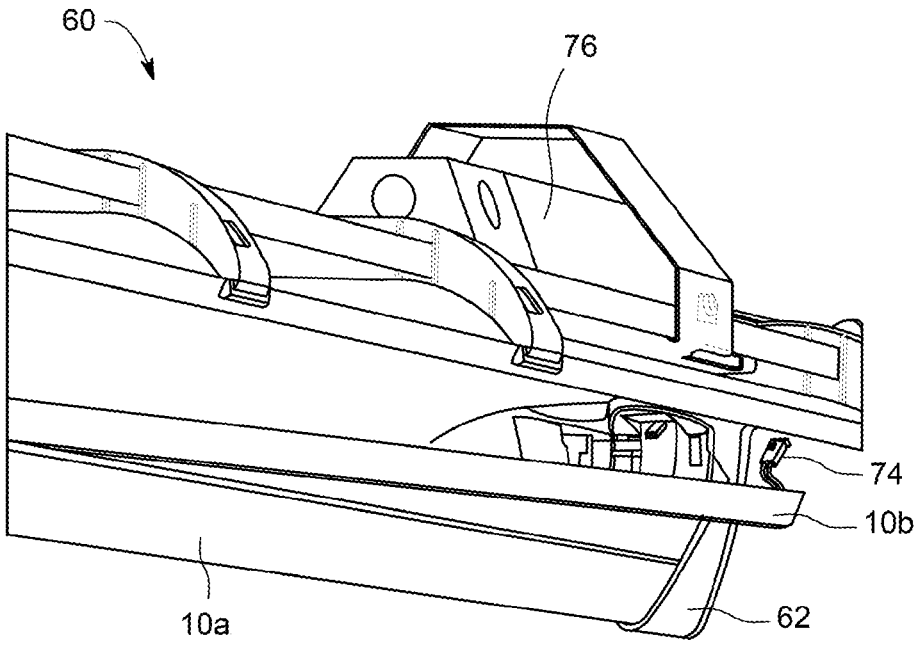
Figure 7E:
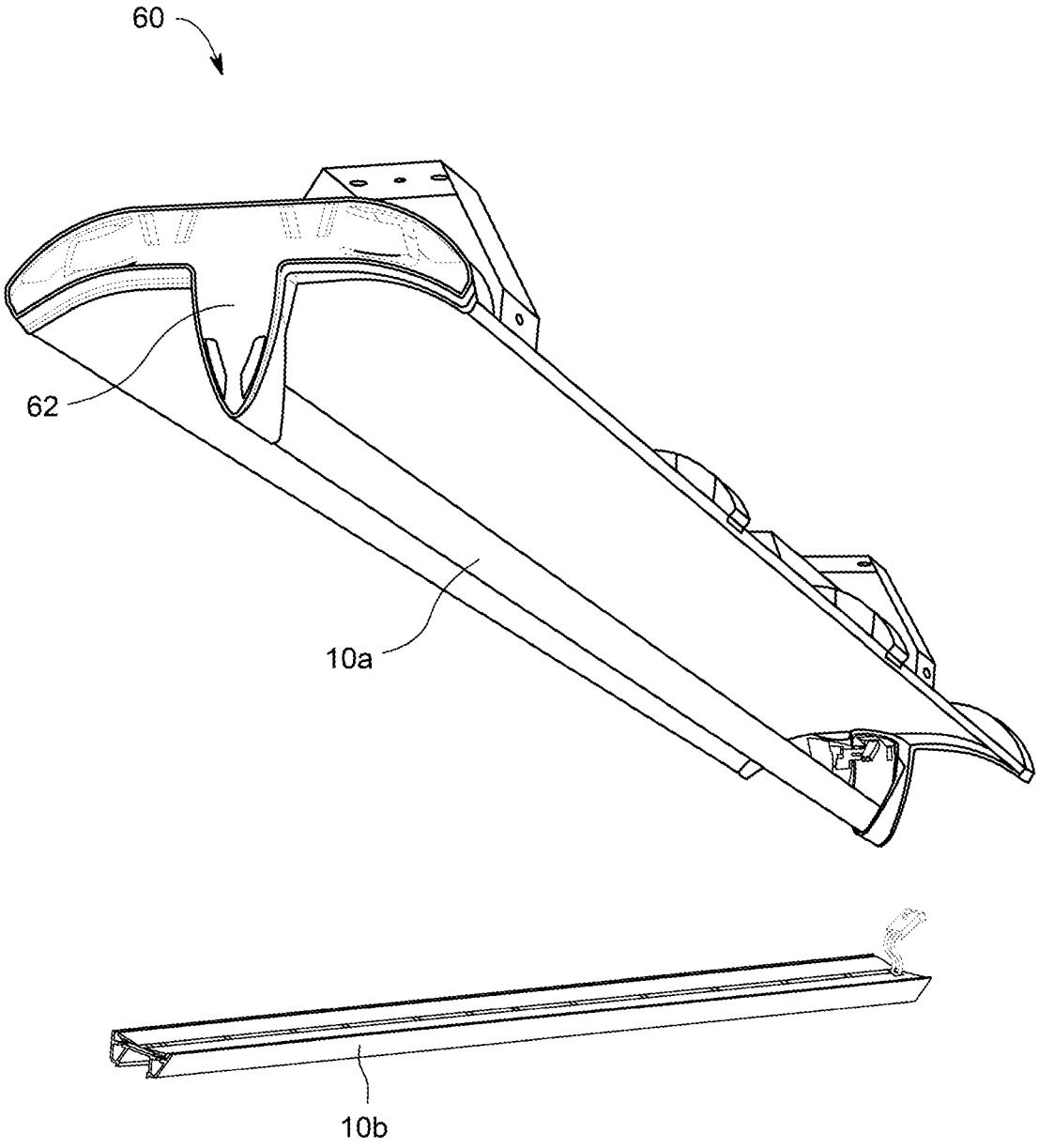

Furthermore, the removal of the replaceable part 10*b* using the prying tool/screwdriver, as shown in FIG. 4A can be started, as demonstrated in FIG. 7C. It is noted that precise instructions (in a manual and/or highlighted on the replaceable part) and the prying tool may be provided with the light fixture for the convenience of the customer. FIG. 7D shows the replaceable part 10*b* being totally removed, so that the electrical connector 74 can be disconnected, thus concluding the removal of the replaceable part 10*b* as finally shown in FIG. 7E.

Figure 8:
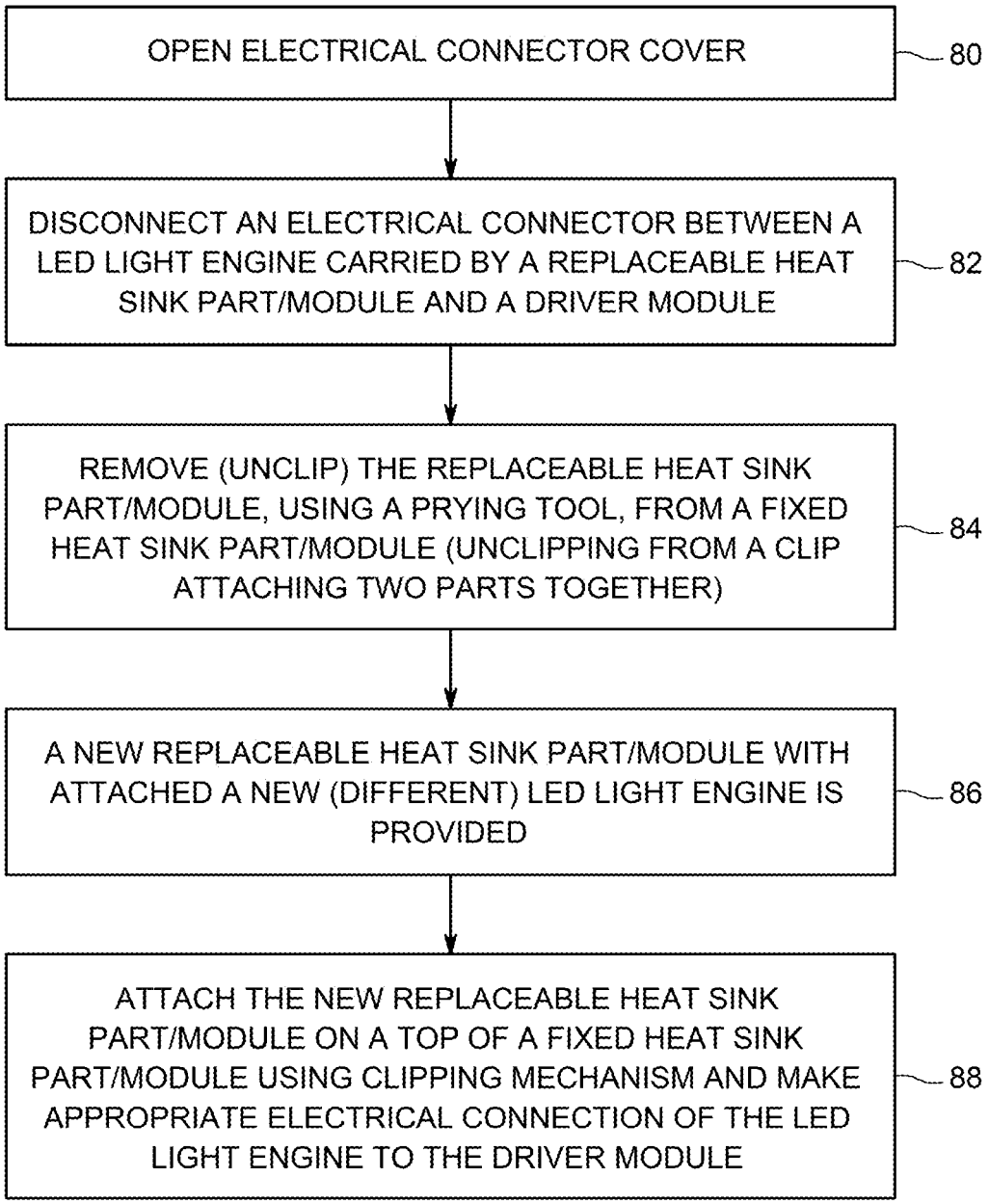
FIG. 8 is a flow chart for implementing replacement of a light engine such as LED light engine according to an embodiment of the invention.

FIG. 8 is a flow chart for implementing replacement/swapping out of a light engine such as LED light engine in a lighting fixture, according to an embodiment of the invention. It is noted that the exact sequence or order of steps shown in FIG. 8 is not required, so in principle, the various steps may be performed out of the illustrated order. Also certain steps may be skipped, different steps may be added or substituted, or selected steps or groups of steps may be performed in a separate application following the embodiments described herein.

In a method according to this exemplary embodiment, as shown in FIG. 8, in a first step 80, an electrical connector cover/door is opened. In a next step 82, an electrical connector between a LED light engine carried by a replaceable heat sink part/module, and a driver module is disconnected. In a next step 84, the replaceable heat sink part/module is removed, using a prying tool, from a fixed heat sink part/module (unclipping from a clip attaching two parts together). In a next step 86, a new LED replaceable heat sink part/module with attached a new (different) LED light engine is provided. In a final step 88, the new replaceable heat sink part/module is attached on a top of a fixed heat sink part/module using a corresponding clipping mechanism (such as "second clipping"), and appropriate electrical connections of the LED light engine to the driver module are made.

Figure 9A:
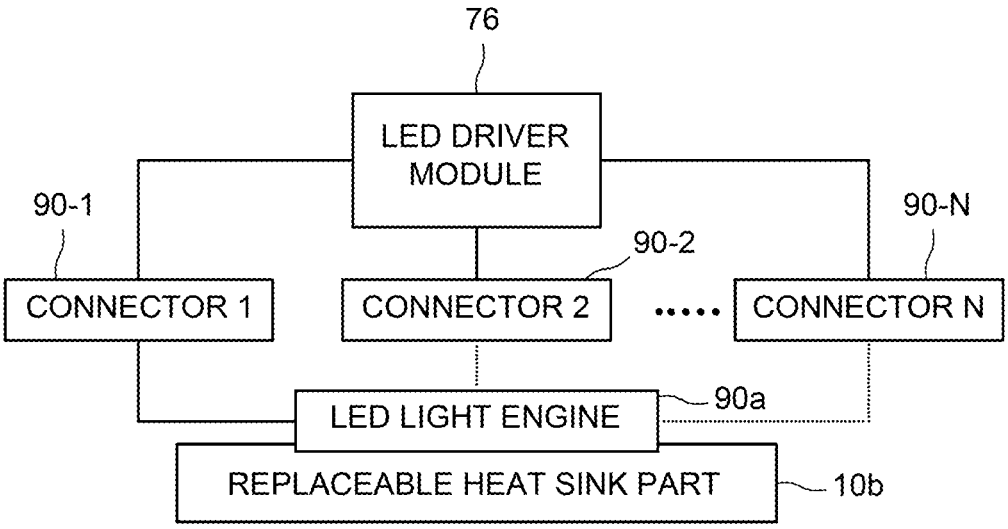
FIGS. 9A-9B are exemplary block diagrams of electrical connections between a replaceable LED light engine, carried by the replaceable heat sink part, and an LED driver module using various electrical connectors, according to further embodiments of the invention.
Figure 9B:
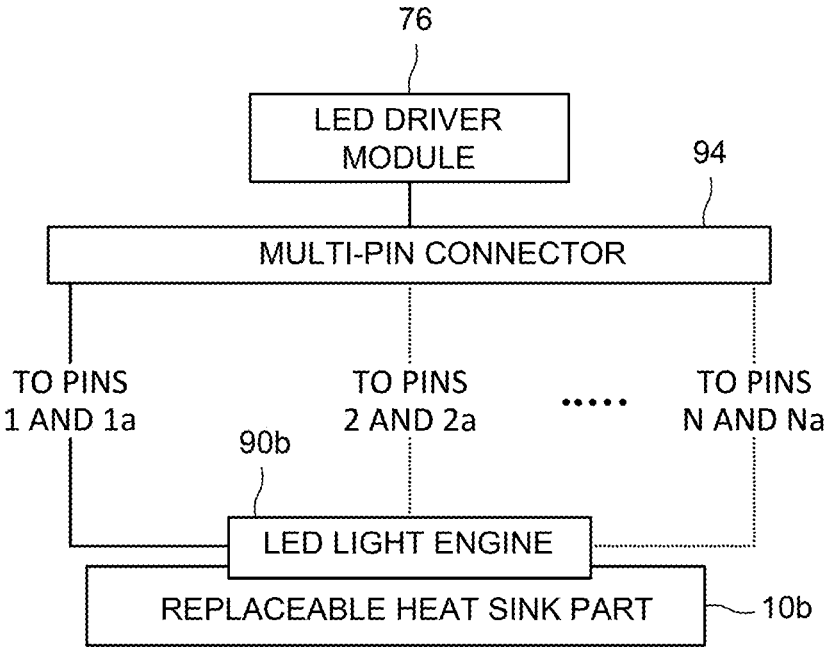

FIGS. 9A-9B are exemplary block diagrams of electrical connections between a replaceable LED light engine 90*a* or 90*b*, carried by the replaceable heat sink part/module 10*b*, and the LED driver module 76 using various electrical connectors, according to further embodiments of the invention.

In both diagrams shown in FIGS. 9A-9B, the LED driver module 76 can be configured to provide a different respective predefined electrical driving power to each replaceable part 10*b* of a plurality of identical replaceable parts carrying different light engines configured to emit different predefined lumen output values.

FIG. 9A demonstrates a multi-connector approach, where N electrical connectors 92-1, 92-2, . . . , 92-N (N being a finite integer) are used for connecting the driver module 76 to different light engines, so that the electrical driving power (different for each of the light engines) is provided by the driver module 76 to each of the different light engines using one dedicated electrical connector (when the driver module 76 senses which connector is connected). Even though the connectors can be marked to identify the particular light engine to connect to, it may be advantageous to have different types of connectors, so that even unintended connection errors can be avoided. In other words, each dedicated electrical connector among N connectors may be a unique type connector different from other dedicated electrical connectors used for connecting other replaceable parts of the plurality of replaceable parts.

FIG. 9B demonstrates a multi-pin approach, where the electrical driving power is provided by the driver module 76 to each of the different light engines using different dedicated pins of one multi-pin electrical connector 94. All N replaceable LED light engines may be connected with the same multi-pin connector 94 but using different pins. For example, one light engine can be connected using pins 1 and 1a, another light engine can be connected using pins 2 and 2a and so on, where the Nth light engine can be connected using pins N and Na. Thus a predefined driving current/power, which is different for each light module, can be only provided to the light engine with connected pins (when the driver module 76 senses which pins are connected). It is noted that the pins 1, 2, . . . N can be connected to a common ground, so that only one common ground pin can be used instead of pins 1, 2, . . . N in the multi-pin electrical connector 94.

Examples of connectors with various number of pins that could be used for the module connections as demonstrated in FIGS. 9A and 9B include (but are not limited to): a) AMP C-0770340-01 & C-770343-1 (male and female), b) AMP C-1445022-2 & C-1445048-02 (male and female), and c) MOLEX 039039022 & 469990293 (male and female).

Unless defined otherwise, technical and scientific terms used herein have the same meaning as is commonly understood by one having ordinary skill in the art to which this disclosure belongs. The terms "first", "second", and the like, as used herein, do not denote any order, quantity, or importance, but rather are employed to distinguish one element from another. Also, the terms "a" and "an" do not denote a limitation of quantity, but rather denote the presence of at least one of the referenced items. The use of "including," "comprising" or "having" and variations thereof herein are meant to encompass the items listed thereafter and equivalents thereof, as well as additional items. The terms "connected" and "coupled" are not restricted to physical or mechanical connections or couplings, and can include electrical and optical connections or couplings, whether direct or indirect.

Furthermore, the skilled artisan will recognize the interchangeability of various features from different embodiments. The various features described, as well as other known equivalents for each feature, can be mixed and matched by one of ordinary skill in this art, to construct additional systems and techniques in accordance with principles of this disclosure.

In describing alternate embodiments of the apparatus claimed, specific terminology is employed for the sake of clarity. The invention, however, is not intended to be limited to the specific terminology so selected. Thus, it is to be understood that each specific element includes all technical equivalents that operate in a similar manner to accomplish similar functions.

It is to be understood that the foregoing description is intended to illustrate and not to limit the scope of the invention, which is defined by the scope of the appended claims. Other embodiments are within the scope of the following claims.

It is noted that various non-limiting embodiments described and claimed herein may be used separately, combined or selectively combined for specific applications.

Further, some of the various features of the above non-limiting embodiments may be used to advantage, without the corresponding use of other described features. The foregoing description should therefore be considered as merely illustrative of the principles, teachings and exemplary embodiments of this invention, and not in limitation thereof.

The invention claimed is:

1. A lighting fixture comprising:

a heat sink comprising two parts: a fixed part, and a replaceable part carrying a light engine which is in thermal contact with the replaceable part, wherein the fixed part is attachable to and detachable from the replaceable part using corresponding clipping and unclipping mechanisms, the replaceable and fixed parts being in juxtaposed aligned relationship when attached; and a clip, located in a space between the fixed and replaceable parts in the attached state, is configured to provide the clipping and unclipping mechanisms.

2. The lighting fixture of claim 1, wherein the light engine comprises one or more light emitting diodes (LEDs).

3. The lighting fixture of claim 1, wherein in the attached state at least one area of the fixed part is in direct contact with at least one further area of the replaceable part to provide continuous thermal conductivity between the fixed and replaceable parts.

4. The lighting fixture of claim 1, wherein in the attached state, continuous thermal conductivity between the fixed and replaceable parts is provided by using any of provisions:

at least one area of the fixed part being in direct contact with at least one further area of the replaceable part, and the clip being a thermal conductor in further direct contact with corresponding areas of the fixed and replaceable parts.

5. The lighting fixture of claim 1, wherein the fixed part is configured to permit passage of electrical wiring for powering adjacent fixtures.

6. The lighting fixture of claim 1, wherein the replaceable and fixed parts are elongated extruded parts.

7. The lighting fixture of claim 1, wherein the fixed part is a hollow extrusion.

8. The lighting fixture of claim 4, wherein the at least one area of the fixed part and the at least one further area of the replaceable part are elongated along a length of the fixed part and of the replaceable part respectively.

9. The lighting fixture of claim 1, wherein the clip comprises a metal material.

10. The lighting fixture of claim 1, wherein the clip comprises a plastic material.

11. The lighting fixture of claim 1, wherein the clip is permanently attached to one of the fixed and replaceable parts.

12. The lighting fixture of claim 1, wherein the clip is replaceable.

13. The lighting fixture of claim 1, wherein the lighting fixture is suspended from a ceiling with the replaceable part being above the fixed part.

14. The lighting fixture of claim 1, wherein the fixed and replaceable parts comprise aluminum.

15. The lighting fixture of claim 1, wherein the lighting fixture further comprises a driver module which is configured to provide a different respective electrical driving power to each replaceable part of a plurality of identical replaceable parts carrying different light engines configured to emit different predefined lumen output values.

16. The lighting fixture of claim 15, wherein the electrical driving power is provided by the driver module to each of the different light engines using a dedicated electrical connector.

17. The lighting fixture of claim 16, wherein each dedicated electrical connector is a unique type connector different from other dedicated electrical connectors used for connecting other replaceable part of the plurality of replaceable parts.

18. The lighting fixture of claim 15, wherein the electrical driving power is provided by the driver module to each of the different light engines using different dedicated pins of one multi-pin electrical connector.

19. The lighting fixture of claim 1, wherein the lighting fixture is configured to be suspended from a ceiling with the replaceable part being below the fixed part using an additional safety lock for the replaceable part in the attached state.

* * * * *